US011202145B1

(12) United States Patent
Oishi et al.

(10) Patent No.: US 11,202,145 B1
(45) **Date of Patent: *Dec. 14, 2021**

(54) SPEAKER ASSEMBLY FOR MITIGATION OF LEAKAGE

(71) Applicant: Facebook Technologies, LLC, Menlo Park, CA (US)

(72) Inventors: Tetsuro Oishi, Bothell, WA (US); Gelmont Rios, Renton, WA (US); Alan Ng, Seattle, WA (US)

(73) Assignee: Facebook Technologies, LLC, Menlo Park, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/115,634

(22) Filed: Dec. 8, 2020

Related U.S. Application Data

(63) Continuation of application No. 16/790,613, filed on Feb. 13, 2020, now Pat. No. 10,893,357.

(51) Int. Cl.

| | |
|---|---|
| ***H04R 1/34*** | (2006.01) |
| ***H04R 1/10*** | (2006.01) |
| ***H04R 5/033*** | (2006.01) |
| ***H04R 1/02*** | (2006.01) |

(52) U.S. Cl.
CPC ..... *H04R 1/345* (2013.01); *H04R 1/105* (2013.01); *H04R 1/1008* (2013.01); *H04R 1/1075* (2013.01); *H04R 1/028* (2013.01); *H04R 1/347* (2013.01); *H04R 5/033* (2013.01); *H04R 2460/11* (2013.01); *H04R 2499/15* (2013.01)

(58) Field of Classification Search
CPC ..... H04R 1/345; H04R 1/1008; H04R 1/105; H04R 1/1075; H04R 2460/11; H04R 5/033; H04R 1/347; H04R 1/028; H04R 2499/15
See application file for complete search history.

(56) References Cited

U.S. PATENT DOCUMENTS

| | | | | |
|---|---|---|---|---|
| 10,869,120 | B1 * | 12/2020 | Jacobs | H04R 1/347 |
| 10,893,357 | B1 * | 1/2021 | Oishi | H04R 5/033 |
| 2005/0248717 | A1 | 11/2005 | Howell et al. | |
| 2012/0170779 | A1 | 7/2012 | Hildebrandt | |

* cited by examiner

*Primary Examiner* — Andrew L Sniezek
(74) *Attorney, Agent, or Firm* — Fenwick & West LLP

(57) ABSTRACT

A speaker assembly presents audio content to an ear canal of a user. A speaker of the speaker assembly generates positive and negative acoustic pressure waves. A first vent assembly of the speaker assembly ports the positive acoustic pressure waves to an entrance of the ear canal of the user, whereas a second vent assembly ports the negative acoustic pressure waves to an area behind a pinna of the user. The first and second vent assembly are configured to provide improved audio content playback to the user.

20 Claims, 6 Drawing Sheets

300

SPEAKER ASSEMBLY FOR MITIGATION OF LEAKAGE

CROSS REFERENCE TO RELATED APPLICATIONS

This application is a continuation of co-pending U.S. application Ser. No. 16/790,613, filed Feb. 13, 2020, which is incorporated by reference in its entirety.

FIELD OF THE INVENTION

This disclosure relates generally to artificial reality systems, and more specifically to a dipole speaker assembly for mitigating leakage of audio content.

BACKGROUND

Headsets often include features such as audio systems to provide audio content to users of the headsets. Conventionally, the headset may include a speaker to present computer-generated sounds to a user of the headset. However, the sounds may leak, causing the audio content generated by the headset to be heard by others around the user.

SUMMARY

A speaker assembly presents audio content to a user. The hooked speaker assembly includes a positive vent assembly located proximate to an entrance to an ear canal of the user and a negative vent assembly located behind a pinna of the user. The positive vent assembly presents the positive acoustic pressure waves to the user, whereas the negative vent outputs negative acoustic pressure waves to mitigate leakage of audio content and reduce interference of unwanted sound coming from around the user.

An audio system comprises a speaker within a body element, the speaker configured to generate positive acoustic pressure waves and negative acoustic pressure waves. The audio system comprises a first vent assembly and a second vent assembly. The first vent assembly, positioned proximate to an entrance to an ear canal of the user, is configured to vent the positive acoustic pressure waves from within the body element to the ear canal. The second vent assembly, positioned behind a pinna of an ear of the user, is configured to vent the negative acoustic pressure waves from within the body element to an area behind the pinna. The audio system further comprises a waveguide within the body element that provides an acoustic pathway for the negative acoustic pressure waves from the speaker to the second vent assembly.

In some embodiments, a headset is disclosed. The headset comprises a frame, a speaker that emits sound comprising positive acoustic pressure waves and negative acoustic pressure waves, and a body element coupled to the frame. The body element encloses the speaker and comprises a first vent assembly, a second vent assembly, and a waveguide. The first vent assembly is configured to vent the positive acoustic pressure waves from within the body element to an entrance to an ear canal of the user. The second vent assembly is configured to vent the negative acoustic pressure waves from within the body element to an area behind a pinna of the user. The waveguide provides an acoustic pathway for the negative acoustic pressure waves from the speaker to the second vent assembly.

Figure 1A:
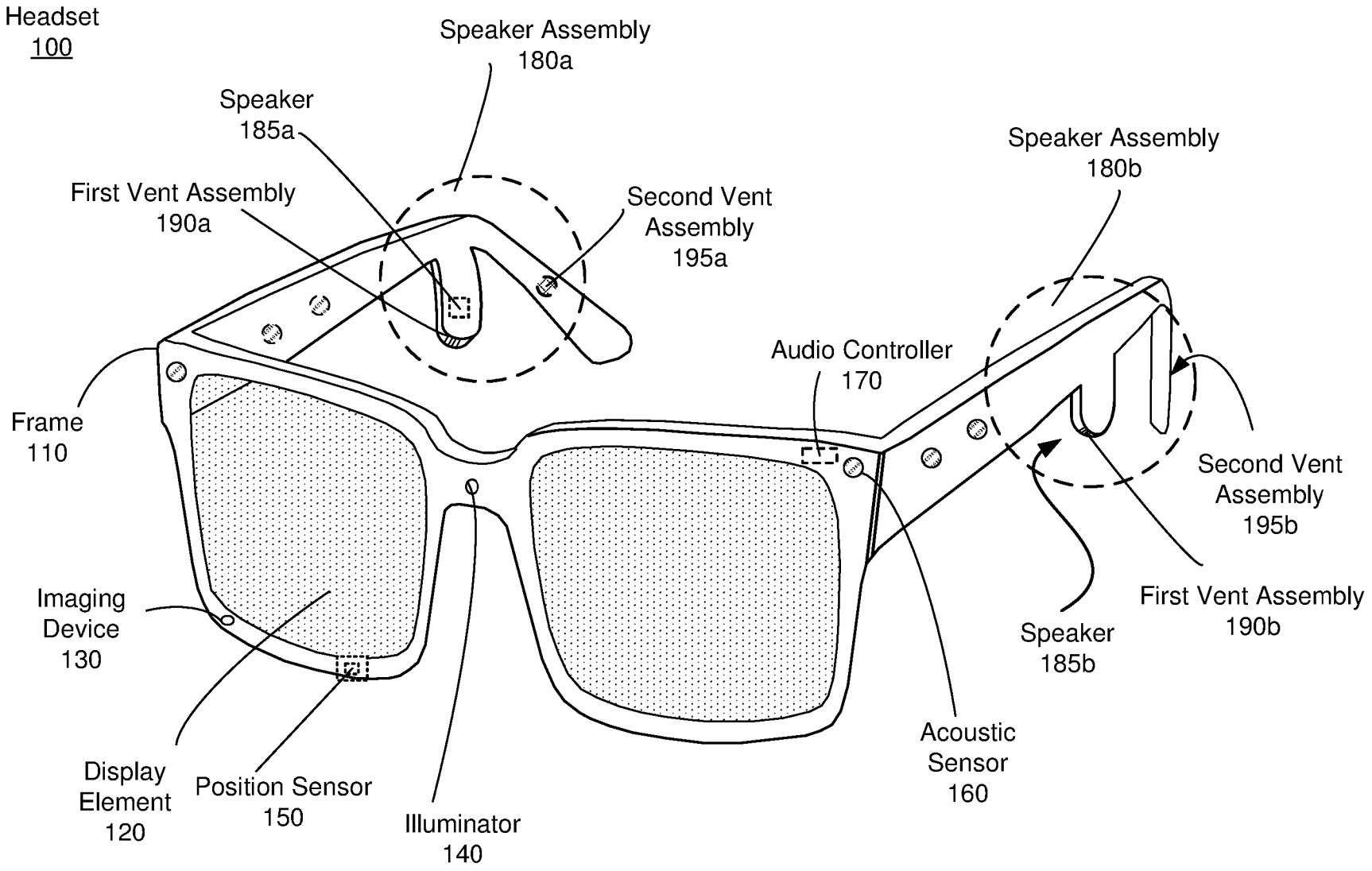
FIG. 1A is a perspective view of a headset implemented as an eyewear device, the headset including a speaker assembly, in accordance with one or more embodiments.

The figures depict various embodiments for purposes of illustration only. One skilled in the art will readily recognize from the following discussion that alternative embodiments of the structures and methods illustrated herein may be employed without departing from the principles described herein.

DETAILED DESCRIPTION

An audio system includes a speaker assembly with a positive vent assembly and a negative vent assembly. The speaker assembly may be a component of a headset that provides the user with audio content. The positive vent assembly is proximate to a speaker of the audio system that presents positive acoustic pressure waves to an entrance to an ear canal of a user of the audio system. The negative vent assembly is positioned behind a pinna of the user and outputs negative acoustic pressure waves (e.g., acoustic pressure waves that are 180 degrees out of phase with the positive acoustic pressure waves) produced by the speaker.

In the far field (particularly for high frequencies) an amount of destructive interference that occurs between the positive acoustic waves and the negative acoustic waves decreases as distance between the positive vent assembly and the negative vent assembly increases. Accordingly, larger amounts of destructive interference in the far field (e.g., less leakage) correlate with having the positive vent assembly and the negative vent assembly close to each other. But for the shadowing effect of the pinna, the close proximity of the positive vent assembly and the negative vent assembly would have a detrimental effect close to the ear (e.g., in the near field), as interference which would occur could result in poor audio performance. Accordingly, the shadowing effect of the pinna mitigates interference of the negative acoustic waves with the positive acoustic pressure waves in the near field, while also mitigating leakage in the far field.

Conventional audio systems may include a dipole speaker that provides audio content to the user. But placement of the vents for the dipole assembly are generally made to optimize the user's experience, which results in large amounts of leakage. In contrast, the speaker assembly facilitates the reduction of interference in a near-field of the audio system (for improved playback of audio content) using shadowing effects of the pinna, while also mitigating leakage of the audio content in the far field.

Embodiments of the invention may include or be implemented in conjunction with an artificial reality system.

Artificial reality is a form of reality that has been adjusted in some manner before presentation to a user, which may include, e.g., a virtual reality (VR), an augmented reality (AR), a mixed reality (MR), a hybrid reality, or some combination and/or derivatives thereof. Artificial reality content may include completely generated content or generated content combined with captured (e.g., real-world) content. The artificial reality content may include video, audio, haptic feedback, or some combination thereof, any of which may be presented in a single channel or in multiple channels (such as stereo video that produces a three-dimensional effect to the viewer). Additionally, in some embodiments, artificial reality may also be associated with applications, products, accessories, services, or some combination thereof, that are used to create content in an artificial reality and/or are otherwise used in an artificial reality. The artificial reality system that provides the artificial reality content may be implemented on various platforms, including a wearable device (e.g., headset) connected to a host computer system, a standalone wearable device (e.g., headset), a mobile device or computing system, or any other hardware platform capable of providing artificial reality content to one or more viewers.

Audio System with Speaker Assembly

FIG. 1A is a perspective view of a headset 100 implemented as an eyewear device, the headset including a speaker assembly 180, in accordance with one or more embodiments. In some embodiments, the eyewear device is a near eye display (NED). In general, the headset 100 may be worn on the face of a user such that content (e.g., media content) is presented using a display assembly and/or an audio system. However, the headset 100 may also be used such that media content is presented to a user in a different manner. Examples of media content presented by the headset 100 include one or more images, video, audio, or some combination thereof. The headset 100 includes a frame, and may include, among other components, a display assembly including one or more display elements 120, a depth camera assembly (DCA), a position sensor, and an audio system. The audio system includes the speaker assembly 180. While FIG. 1A illustrates the components of the headset 100 in example locations on the headset 100, the components may be located elsewhere on the headset 100, on a peripheral device paired with the headset 100, or some combination thereof. Similarly, there may be more or fewer components on the headset 100 than what is shown in FIG. 1A.

The frame 110 holds the other components of the headset 100. The frame 110 includes a front part that holds the one or more display elements 120 and end pieces (e.g., temples) to attach to a head of the user. The front part of the frame 110 bridges the top of a nose of the user. The length of the end pieces may be adjustable (e.g., adjustable temple length) to fit different users. The end pieces may also include a portion that curls behind the ear of the user (e.g., temple tip, ear piece).

The one or more display elements 120 provide light to a user wearing the headset 100. As illustrated the headset includes a display element 120 for each eye of a user. In some embodiments, a display element 120 generates image light that is provided to an eyebox of the headset 100. The eyebox is a location in space that an eye of user occupies while wearing the headset 100. For example, a display element 120 may be a waveguide display. A waveguide display includes a light source (e.g., a two-dimensional source, one or more line sources, one or more point sources, etc.) and one or more waveguides. Light from the light source is in-coupled into the one or more waveguides which outputs the light in a manner such that there is pupil replication in an eyebox of the headset 100. In-coupling and/or outcoupling of light from the one or more waveguides may be done using one or more diffraction gratings. In some embodiments, the waveguide display includes a scanning element (e.g., waveguide, mirror, etc.) that scans light from the light source as it is in-coupled into the one or more waveguides. Note that in some embodiments, one or both of the display elements 120 are opaque and do not transmit light from a local area around the headset 100. The local area is the area surrounding the headset 100. For example, the local area may be a room that a user wearing the headset 100 is inside, or the user wearing the headset 100 may be outside and the local area is an outside area. In this context, the headset 100 generates VR content. Alternatively, in some embodiments, one or both of the display elements 120 are at least partially transparent, such that light from the local area may be combined with light from the one or more display elements to produce AR and/or MR content.

In some embodiments, a display element 120 does not generate image light, and instead is a lens that transmits light from the local area to the eyebox. For example, one or both of the display elements 120 may be a lens without correction (non-prescription) or a prescription lens (e.g., single vision, bifocal and trifocal, or progressive) to help correct for defects in a user's eyesight. In some embodiments, the display element 120 may be polarized and/or tinted to protect the user's eyes from the sun.

In some embodiments, the display element 120 may include an additional optics block (not shown). The optics block may include one or more optical elements (e.g., lens, Fresnel lens, etc.) that direct light from the display element 120 to the eyebox. The optics block may, e.g., correct for aberrations in some or all of the image content, magnify some or all of the image, or some combination thereof.

The DCA determines depth information for a portion of a local area surrounding the headset 100. The DCA includes one or more imaging devices 130 and a DCA controller (not shown in FIG. 1A), and may also include an illuminator 140. In some embodiments, the illuminator 140 illuminates a portion of the local area with light. The light may be, e.g., structured light (e.g., dot pattern, bars, etc.) in the infrared (IR), IR flash for time-of-flight, etc. In some embodiments, the one or more imaging devices 130 capture images of the portion of the local area that include the light from the illuminator 140. As illustrated, FIG. 1A shows a single illuminator 140 and a single imaging device 130. In alternate embodiments, there is no illuminator 140 and at least two imaging devices 130.

The DCA controller computes depth information for the portion of the local area using the captured images and one or more depth determination techniques. The depth determination technique may be, e.g., direct time-of-flight (ToF) depth sensing, indirect ToF depth sensing, structured light, passive stereo analysis, active stereo analysis (uses texture added to the scene by light from the illuminator 140), some other technique to determine depth of a scene, or some combination thereof.

The position sensor 150 generates one or more measurement signals in response to motion of the headset 100. The position sensor 150 may be located on a portion of the frame 110 of the headset 100. The position sensor 150 may include an inertial measurement unit (IMU). Examples of position sensor 150 include: one or more accelerometers, one or more gyroscopes, one or more magnetometers, another suitable type of sensor that detects motion, a type of sensor used for error correction of the IMU, or some combination thereof.

The position sensor 150 may be located external to the IMU, internal to the IMU, or some combination thereof.

In some embodiments, the headset 100 may provide for simultaneous localization and mapping (SLAM) for a position of the headset 100 and updating of a model of the local area. For example, the headset 100 may include a passive camera assembly (PCA) that generates color image data. The PCA may include one or more RGB cameras that capture images of some or all of the local area. In some embodiments, some or all of the imaging devices 130 of the DCA may also function as the PCA. The images captured by the PCA and the depth information determined by the DCA may be used to determine parameters of the local area, generate a model of the local area, update a model of the local area, or some combination thereof. Furthermore, the position sensor 150 tracks the position (e.g., location and pose) of the headset 100 within the room.

The audio system provides audio content to the user of the headset 100. The audio system includes a sensor array, an audio controller 160, and the speaker assemblies 180*a*, 180*b* (collectively referred to as the speaker assemblies 180). However, in other embodiments, the audio system may include different and/or additional components. Similarly, in some cases, functionality described with reference to the components of the audio system can be distributed among the components in a different manner than is described here. For example, some or all of the functions of the controller may be performed by a remote server.

The sensor array detects sounds within the local area of the headset 100. The sensor array includes a plurality of acoustic sensors 160. An acoustic sensor 160 captures sounds emitted from one or more sound sources in the local area (e.g., a room). Each acoustic sensor is configured to detect sound and convert the detected sound into an electronic format (analog or digital). The acoustic sensors 160 may be acoustic wave sensors, microphones, sound transducers, or similar sensors that are suitable for detecting sounds.

In some embodiments, one or more acoustic sensors 160 may be placed in an ear canal of each ear (e.g., acting as binaural microphones). In some embodiments, the acoustic sensors 160 may be placed on an exterior surface of the headset 100, placed on an interior surface of the headset 100, separate from the headset 100 (e.g., part of some other device), or some combination thereof. The number and/or locations of acoustic sensors 160 may be different from what is shown in FIG. 1A. For example, the number of acoustic detection locations may be increased to increase the amount of audio information collected and the sensitivity and/or accuracy of the information. The acoustic detection locations may be oriented such that the microphone is able to detect sounds in a wide range of directions surrounding the user wearing the headset 100.

The audio controller 170 processes information from the sensor array that describes sounds detected by the sensor array. The audio controller 170 may comprise a processor and a computer-readable storage medium. The audio controller 170 may be configured to generate direction of arrival (DOA) estimates, generate acoustic transfer functions (e.g., array transfer functions and/or head-related transfer functions), track the location of sound sources, form beams in the direction of sound sources, classify sound sources, generate sound filters for the speaker assemblies 180, or some combination thereof.

The speaker assemblies 180 present acoustic content to user and limits the leakage of the acoustic content in the far field by pinna shadowing. In some embodiments, the headset 100 includes a speaker assembly 180*a*, 180*b* for each ear of the user. The speaker assembly 180*a* includes a speaker 185*a*, a first vent assembly 190*a*, and a second vent assembly 195*a*. The speaker assembly 180*b* includes a speaker 185*b*, a first vent assembly 190*b*, and a second vent assembly 195*b*. The speakers 185*a*, 185*b* are collectively referred to as the speaker 185. The speaker assemblies 180 may include more components than those described herein. The speaker assembly 180*a* and/or the speaker assembly 180*b* may be integrated with the headset 100. In some embodiments, the speaker assembly 180*a* and/or the speaker assembly 180*b* may be separate from but couple to the headset 100.

The speakers 185 generate sound in accordance with instructions from the audio controller 170. The speaker 185*a*, 185*b* is a transducer that produces, by air conduction, positive acoustic pressure waves and negative acoustic pressure waves. Negative pressure waves are acoustic pressure waves that are 180 degrees out of phase with the positive acoustic pressure waves and may disturb the user's listening experience. The speaker 185*a* and the speaker 185*b* are enclosed within a respective body element of the speaker assembly 180*a* and 180*b*. In some embodiments, the speakers 185 are positioned proximate to an entrance to a respective ear canal of the user. In some embodiments, one or both of the speaker assemblies 180 include more than one speaker (e.g., the speaker 185*a*). The one or more speakers may be integrated into the frame 110 to improve the directionality of audio content presented to the user. In some embodiments, one or both of the speaker assemblies 180 include tissue conduction transducers (e.g., bone and/or cartilage conduction transducers). The tissue conduction transducers couple to the head of the user and directly vibrate tissue (e.g., bone or cartilage) of the user to generate sound.

A first vent assembly provides positive acoustic pressure waves (i.e., audio content) to an entrance of an ear canal of the user. For example, the first vent assembly 190*a* provides positive acoustic pressure waves to an entrance to an ear canal of a right ear of the user, and the first vent assembly 190*b* provides positive acoustic pressure waves to an entrance to an ear canal of a left ear of the user. The first vent assemblies 190 may also be referred to as positive vent assemblies. In some embodiments, one or both of the first vent assemblies 190 are positioned proximate to respective entrances to ear canals of the user. For example, in some embodiments, one or both of the first vent assemblies 190 are within 15 mm of the entrance to the ear canal. Proximity to the entrance to the ear canal can reduce power requirements to provide high fidelity audio content to the ear. The positive acoustic pressure waves travel through the user's ear canal to an ear drum of the user. The ear drum of the user detects the acoustic pressure waves as sound.

The second vent assemblies 195 vent negative acoustic pressure waves into the local area. The second vent assembly 195*a* and the first vent assembly 190*b* are positioned such that a pinna of the right ear is between them, and the ear canal (and in some cases the first vent assembly 190*a*) is in an acoustic shadow of the pinna. Similarly, the second vent assembly 195*b* and the first vent assembly 190*b* are positioned such that a pinna of the left ear is between them, and the ear canal (and in some cases the first vent assembly 190*b*) is in an acoustic shadow of the pinna. The placement of the pinna between a first vent assembly and a second vent assembly causes shadowing effects that mitigate destructive interference that would otherwise occur if the path between them was not obstructed by the pinna. Accordingly, the pinna shadowing improves playback of audio content in a near acoustic field of the audio system. Moreover, as the pinna has little effect in a far acoustic field, destructive interference occurs between the positive acoustic waves and the negative acoustic waves occurs in the far acoustic field, thereby mitigating leakage. In some embodiments, one or both of the second vent assemblies 195 are parallel to their corresponding first vent assembly (190*a* or 190*b*). A waveguide (not pictured in FIG. 1A) provides an acoustic pathway for the negative acoustic pressure waves from the speaker 185*a* to the second vent assembly 195*a*. And a different waveguide (also not shown) provides an acoustic pathway for the negative acoustic pressure waves from the speaker 185*b* to the second vent assembly 195*b*.

The first vent assemblies 190 and the second vent assemblies 195 each form one or more apertures that output acoustic pressure waves. The apertures have a shape. For example, the shape may be rectangular, circular, or any other shape. In some embodiments, a first vent assembly and/or a second vent assembly have a plurality of apertures. In some embodiments, the plurality of apertures for a particular vent assembly (first vent assembly or second vent assembly) have the same shape. In other embodiments, at least one of the plurality of apertures of the particular vent assembly is different from another aperture of the plurality of apertures. In some embodiments, some or all of the one or more apertures are covered by a mesh. In other embodiments, some or all of the apertures are not covered by a mesh.

Figure 1B:
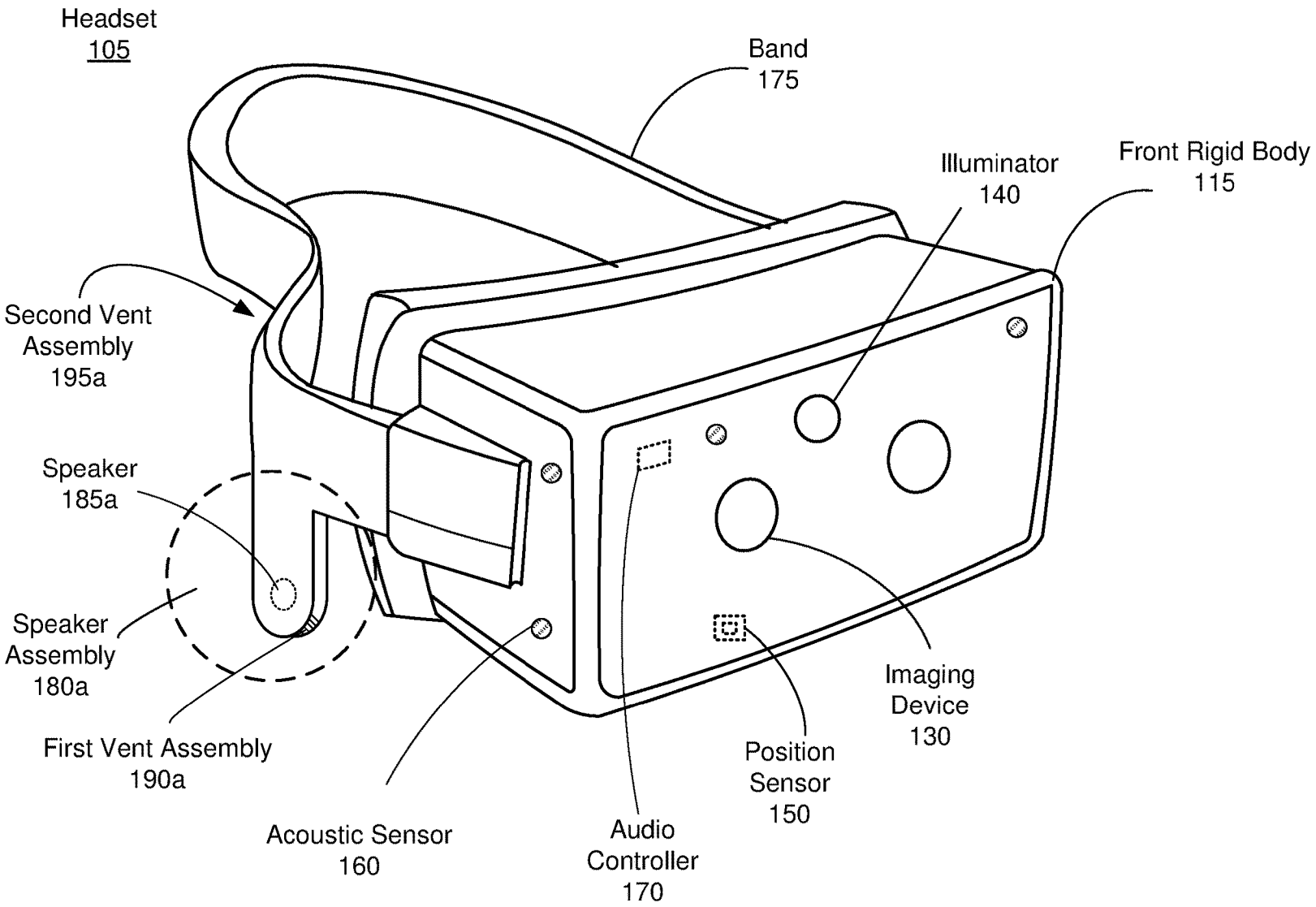
FIG. 1B is a perspective view of a headset implemented as a head-mounted display, the headset including the speaker assemblies of FIG. 1A, in accordance with one or more embodiments.

FIG. 1B is a perspective view of a headset 105 implemented as a head-mounted display, the headset 105 including the speaker assemblies 180 of FIG. 1A, in accordance with one or more embodiments. In embodiments that describe an AR system and/or a MR system, portions of a front side of the HMD are at least partially transparent in the visible band (~380 nm to 750 nm), and portions of the HMD that are between the front side of the HMD and an eye of the user are at least partially transparent (e.g., a partially transparent electronic display). The HMD includes a front rigid body 115, a band 175, and the speaker assembly 180. The headset 105 includes many of the same components described above with reference to FIG. 1A, but modified to integrate with the HMD form factor. For example, the HMD includes a display assembly, a DCA, and an audio system including the speaker assemblies 180. FIG. 1B shows a plurality of imaging devices 130, the illuminator 140, the position sensor 150, a plurality of the acoustic sensors 160, and the speaker assemblies 180.

Note that while FIG. 1B includes the speaker assembly 180*a* and the speaker assembly 180*b*, however, the speaker assembly 180*b* is not visible in this view point. The speaker assembly 180*a* includes the speaker 185*a*, the first vent assembly 190*a*, and the second vent assembly 195*a*. The speaker assemblies 180*a*, 180*b* may be integrated into the band 175, as shown in FIG. 1B.

Figure 2:
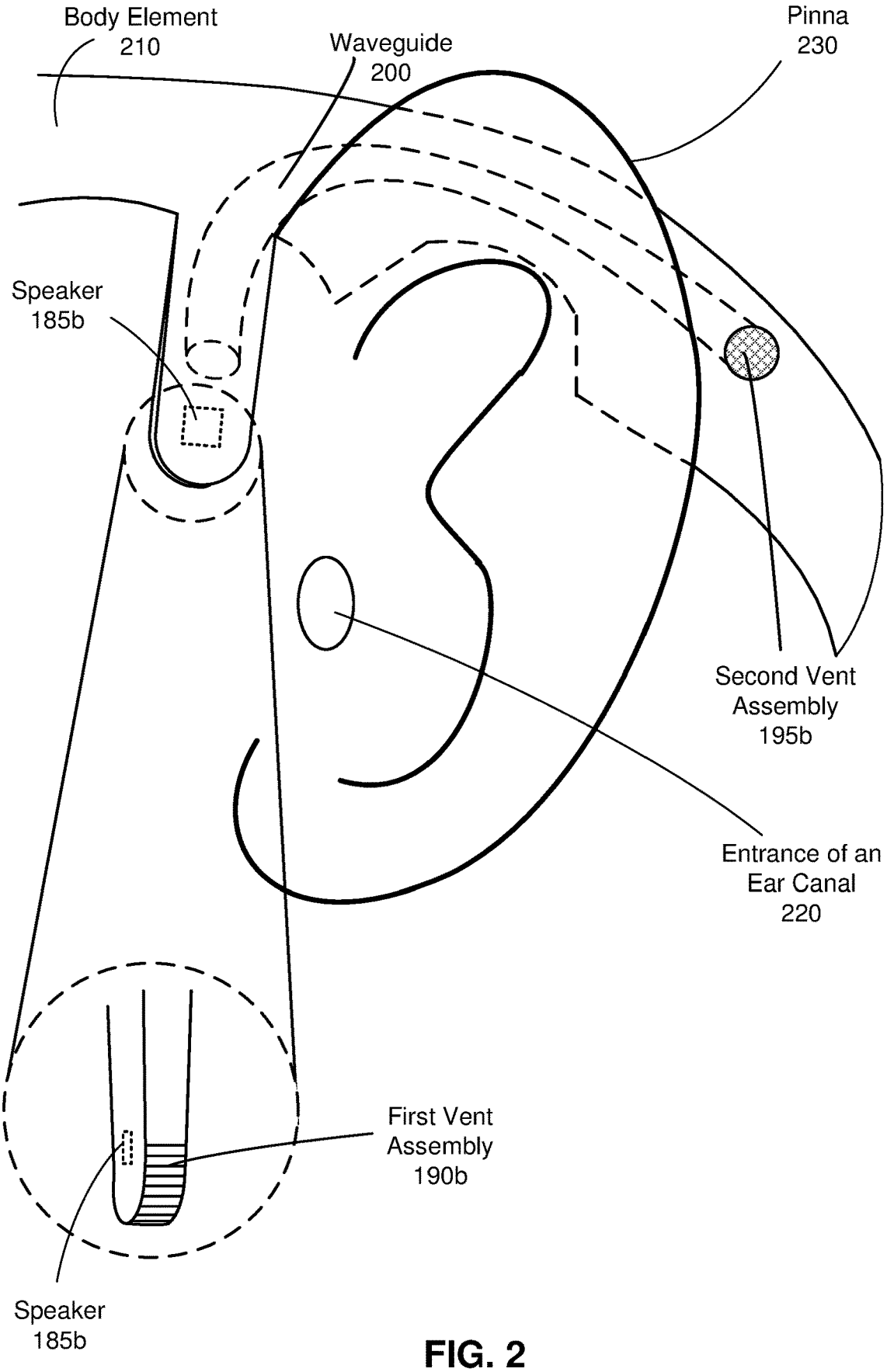
FIG. 2 is a side view of the speaker assembly of the headset of FIG. 1A, in accordance with one or more embodiments.

FIG. 2 is a side view of the speaker assembly 180*b* of the headset 100 of FIG. 1A, in accordance with one or more embodiments. The speaker assembly 180*b* includes, as described in FIGS. 1A-B, the speaker 185*b*, the first vent assembly 190*b*, and the second vent assembly 195*b*, as well as a waveguide 200, within a body element 210. FIG. 2 also shows an entrance of an ear canal 220 and a pinna 230 of an ear of the user of the headset 100. Note that while the speaker assembly 180*b* is shown, in some embodiments, speaker 180*a* is substantially similar but modified to be used with the right ear of the user.

The speaker 185*b*, as described with respect to FIG. 1, generates sound. The sound may be in the form of positive acoustic pressure waves and negative acoustic pressure waves. In some embodiments, the speaker 185*b* is internal to the body element 210 of the speaker assembly 180*b*.

The first vent assembly 190*b* outputs the positive acoustic pressure waves generated by the speaker 185*b* to the entrance of the ear canal 220. In some embodiments, the positive acoustic pressure waves generated by the speaker 185*b* are directly vented into the local area (e.g., towards the entrance of the ear canal 220). In some embodiments, the positive acoustic pressure waves travel from the speaker 185*b* to the first vent assembly 190*b* via a waveguide (not pictured in FIG. 2). The waveguide is a channel that may be made from the body element 210 of the speaker assembly 180. The first vent assembly 190*b* is positioned proximate to the speaker 185*b* and to the entrance of the ear canal 220 of the user.

Negative acoustic pressure waves travel from the speaker 185*b* through the waveguide 200. The waveguide 200 provides an acoustic pathway for the negative acoustic pressure waves from the speaker 185*b* to the second vent assembly 195*b*. The waveguide 200 is a channel that may be made from the body element 210 of the speaker assembly 180*b*. In some embodiments, the waveguide 200 is separate from the body element 210. For example, the waveguide 200 may be a separate tube inserted into the body element 210.

The second vent assembly 195*b* and the first vent assembly 190*b* are positioned such that the pinna 230 is between them, and the entrance of the ear canal 220 (and in some cases the first vent assembly 190*b*) is in an acoustic shadow of the pinna. The placement of the pinna 230 between the first vent assembly 190*b* and the second vent assembly 195*b* causes shadowing effects that mitigate destructive interference that would otherwise occur if the path between them was not obstructed by the pinna 230. The pinna 230 prevents some or all of the negative acoustic pressure waves output from the second vent assembly 195*b* from destructively interfering with the positive acoustic pressure waves output from the first vent assembly 190*b* toward the entrance of the ear canal 220. Accordingly, the shadowing improves playback of audio content in a near acoustic field of the audio system. Moreover, as the pinna has little effect in a far acoustic field, destructive interference occurs between the positive acoustic waves and the negative acoustic waves occurs in the far acoustic field, thereby mitigating leakage.

Figure 3:
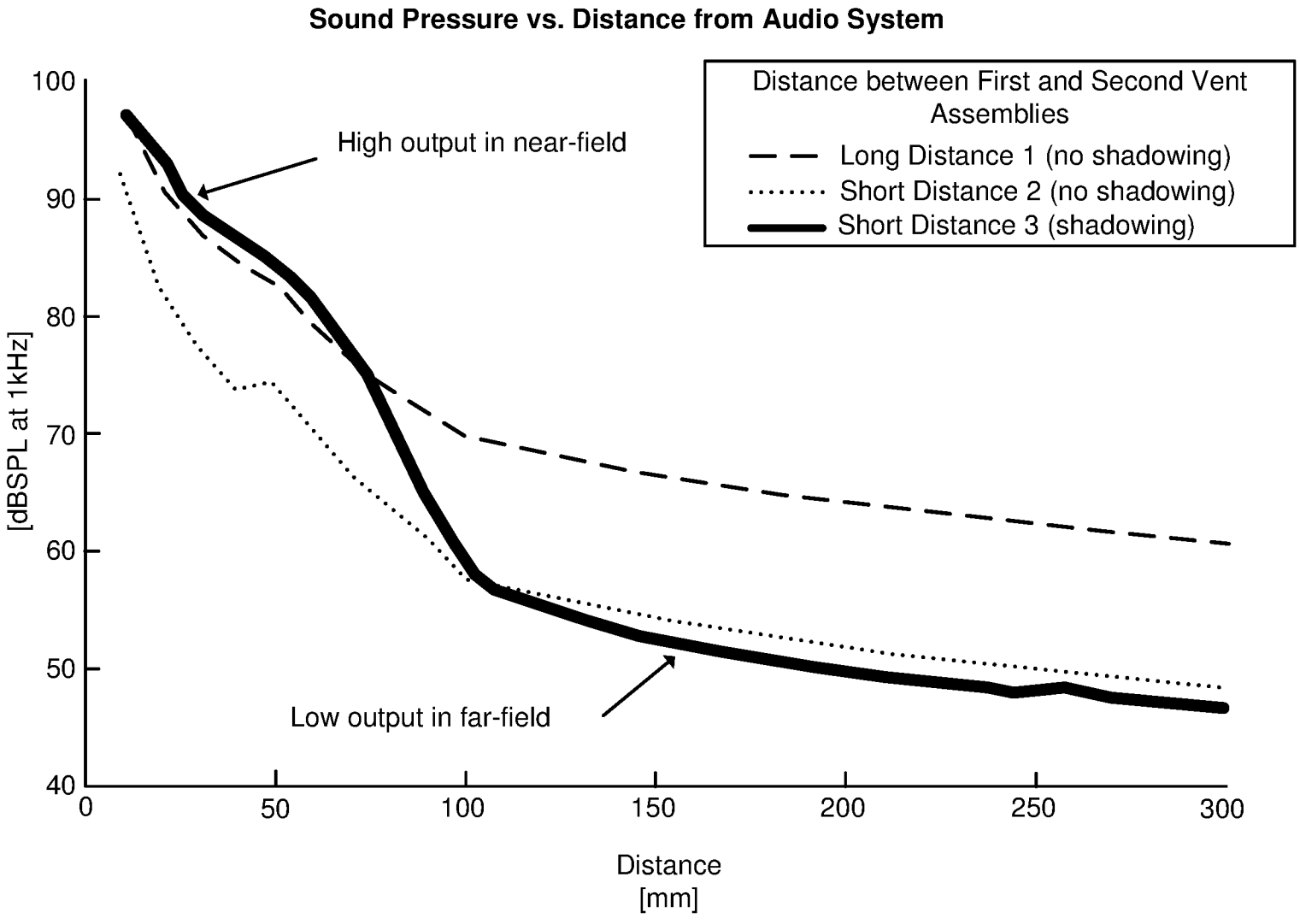
FIG. 3 is a graph showing sound pressure as a function of distance, in accordance with one or more embodiments.

FIG. 3 is a graph 300 showing sound pressure as a function of distance, in accordance with one or more embodiments. The graph 300 shows how sound pressure changes as a function of distance from a conventional audio system (no shadowing effects of the pinna) and an audio system (e.g., the audio system of FIG. 1*a*) with shadowing effects of the pinna. The graph 300 includes a first plot representing a conventional audio system configured to have a long distance 1 (e.g., 50 mm) between a positive vent assembly and a corresponding negative vent assembly for a given ear (e.g., right), and in the conventional audio system there is no shadowing effects from a pinna of the ear. The graph 300 also includes a second plot representing the conventional audio system modified to have a short distance 2 (e.g., 10 mm) between its positive and negative vent assemblies, and again has no shadowing effects from the pinna. The graph 300 also includes a third plot representing the audio system (e.g., the audio system of FIG. 1A) with a short distance 3 between its first and second vent assemblies (e.g., the first vent assembly 190*a* and the second vent assembly 195*a*) with shadowing effects from the pinna. In this figure, each of the distances is a line of sight distance, and the short distance 2 and the short distance 3 are a same distance.

Note that for the conventional audio system as the distance between the positive and negative vent assemblies increase, there is a higher sound pressure. The higher sound pressure is due in part to less destructive interference occurring. For example, at 25 mm from the conventional audio system, there is approximately 90 dB of sound pressure for the long distance 1 configuration, but only about 80 dB of sound pressure for the short distance 2 configuration. Accordingly, in a conventional audio system having a small distance between the positive and negative vent assemblies can have a negative impact on playback to the user.

And again for the conventional audio system, as one moves farther away from the audio system (e.g., into the far field), the audio system in the long distance 1 has a substantially larger signal than the audio system in the short distance 2 configuration. For example, at 300 mm from the conventional audio system, there is approximately 62 dB of sound pressure for the long distance 1, but only about 48 dB of sound pressure for the short distance 2. Accordingly, in the far field, the smaller spacing between the positive vent assembly and the negative vent assembly provide for substantially better mitigation of leakage. But to have such leakage control in the far field with a conventional audio system would result in relatively poor playback in the near field. Accordingly, in conventional audio spacings there can be a significant tradeoff between playback quality and mitigation of leakage.

In contrast, the audio system (e.g., of FIG. 1A) has higher sound pressure that of the conventional audio system in the near field (i.e., better playback), as well lower sound pressure than that of the audio system in the far field (i.e., better mitigation of leakage). For example, as illustrated at 25 mm from the audio system in the short distance 3 configuration, which includes shadowing effects of the pinna, has a higher sound pressure than the conventional audio system in both the short distance 2 and the long distance 1 configurations. Moreover, at larger distances from the audio system (e.g., in the far field) the audio system in the short distance 3 configuration has a lower sound pressure than the conventional audio system in both the long distance 1 and the short distance 2 configurations.

Figure 4:
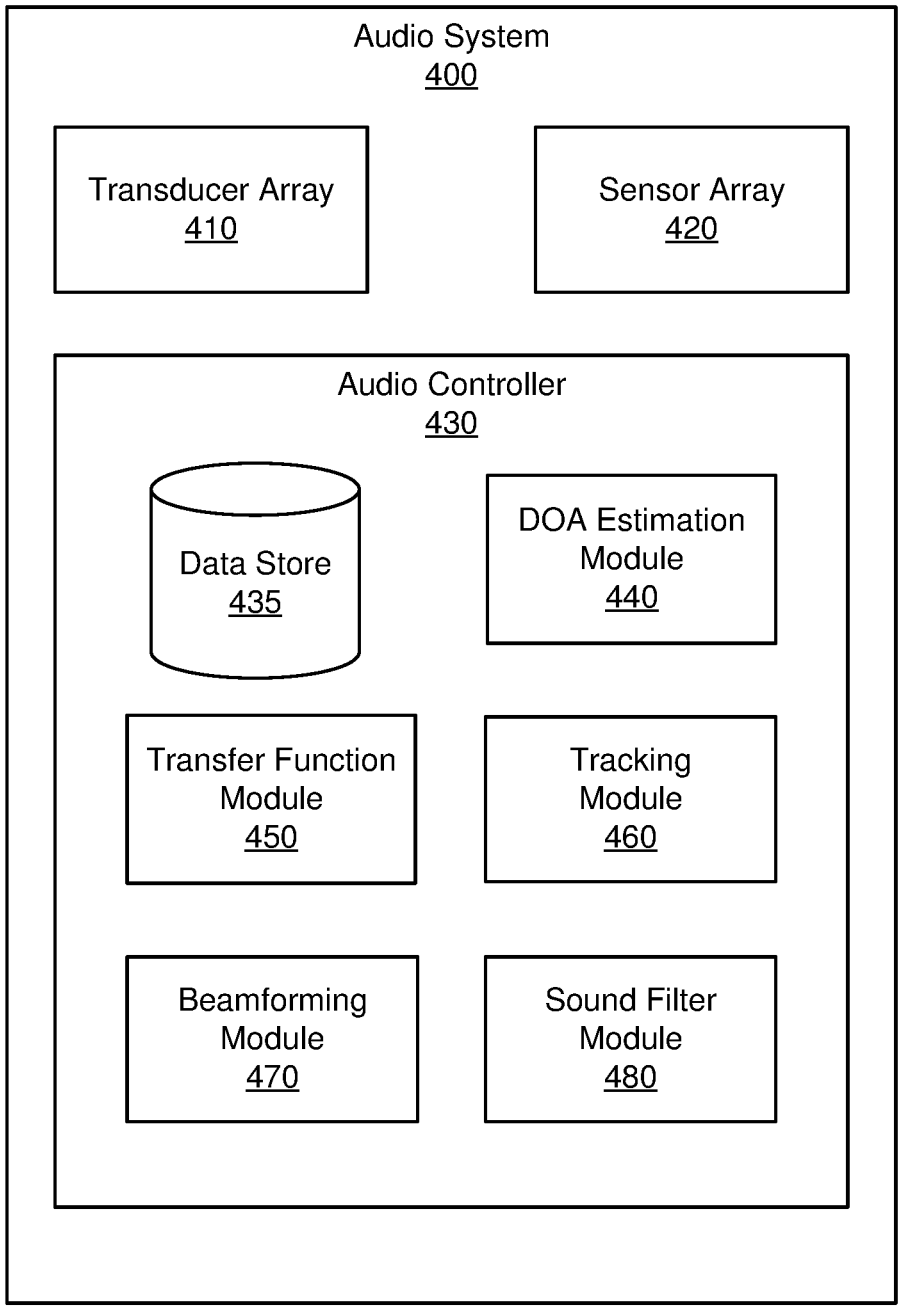
FIG. 4 is a block diagram of an audio system, in accordance with one or more embodiments.

FIG. 4 is a block diagram of an audio system 400, in accordance with one or more embodiments. The audio system in FIG. 1A or FIG. 1B may be an embodiment of the audio system 400. The audio system 400 generates one or more acoustic transfer functions for a user. The audio system 400 may then use the one or more acoustic transfer functions to generate audio content for the user. In the embodiment of FIG. 4, the audio system 400 includes a transducer array 410, a sensor array 420, and an audio controller 430. In some embodiments, the audio system 400 includes the speaker assemblies 180. Some embodiments of the audio system 400 have different components than those described here. Similarly, in some cases, functions can be distributed among the components in a different manner than is described here.

The transducer array 410 is configured to present audio content. The transducer array 410 includes a plurality of transducers. A transducer is a device that provides audio content. A transducer may be, e.g., a speaker (e.g., the speaker 185), a tissue transducer, some other device that provides audio content, or some combination thereof. A tissue transducer may be configured to function as a bone conduction transducer or a cartilage conduction transducer. The transducer array 410 may present audio content via air conduction (e.g., via one or more speakers), via bone conduction (via one or more bone conduction transducer), via cartilage conduction audio system (via one or more cartilage conduction transducers), or some combination thereof. In some embodiments, the transducer array 410 may include one or more transducers to cover different parts of a frequency range. For example, a piezoelectric transducer may be used to cover a first part of a frequency range and a moving coil transducer may be used to cover a second part of a frequency range.

The bone conduction transducers generate acoustic pressure waves by vibrating bone/tissue in the user's head. A bone conduction transducer may be coupled to a portion of a headset, and may be configured to be behind the auricle coupled to a portion of the user's skull. The bone conduction transducer receives vibration instructions from the audio controller 430, and vibrates a portion of the user's skull based on the received instructions. The vibrations from the bone conduction transducer generate a tissue-borne acoustic pressure wave that propagates toward the user's cochlea, bypassing the eardrum.

The cartilage conduction transducers generate acoustic pressure waves by vibrating one or more portions of the auricular cartilage of the ears of the user. A cartilage conduction transducer may be coupled to a portion of a headset, and may be configured to be coupled to one or more portions of the auricular cartilage of the ear. For example, the cartilage conduction transducer may couple to the back of an auricle of the ear of the user. The cartilage conduction transducer may be located anywhere along the auricular cartilage around the outer ear (e.g., the pinna, the tragus, some other portion of the auricular cartilage, or some combination thereof). Vibrating the one or more portions of auricular cartilage may generate: airborne acoustic pressure waves outside the ear canal; tissue born acoustic pressure waves that cause some portions of the ear canal to vibrate thereby generating an airborne acoustic pressure wave within the ear canal; or some combination thereof. The generated airborne acoustic pressure waves propagate down the ear canal toward the ear drum.

The transducer array 410 generates audio content in accordance with instructions from the audio controller 430. In some embodiments, the audio content is spatialized. Spatialized audio content is audio content that appears to originate from a particular direction and/or target region (e.g., an object in the local area and/or a virtual object). For example, spatialized audio content can make it appear that sound is originating from a virtual singer across a room from a user of the audio system 400. The transducer array 410 may be coupled to a wearable device (e.g., the headset 100 or the headset 105). In alternate embodiments, the transducer array 410 may be a plurality of speakers that are separate from the wearable device (e.g., coupled to an external console).

The transducer array 410 includes one or more speaker assemblies which enable pinna shadowing to limit the leakage of sound produced by the transducer array 410 and enhancing playback for the user. In some embodiments, the speaker assembly may be an embodiment of the speaker assembly 180*a* and/or 180*b*, with a positive vent assembly that outputs positive acoustic pressure waves to an entrance of an ear canal of the user, and a negative vent assembly positioned behind a pinna of the user that outputs negative acoustic pressure waves.

The sensor array 420 detects sounds within a local area surrounding the sensor array 420. The sensor array 420 may include a plurality of acoustic sensors that each detect air pressure variations of a sound wave and convert the detected sounds into an electronic format (analog or digital). The plurality of acoustic sensors may be positioned on a headset (e.g., headset 100 and/or the headset 105), on a user (e.g., in an ear canal of the user), on a neckband, or some combination thereof. An acoustic sensor may be, e.g., a microphone, a vibration sensor, an accelerometer, or any combination thereof. In some embodiments, the sensor array 420 is configured to monitor the audio content generated by the transducer array 410 using at least some of the plurality of acoustic sensors. Increasing the number of sensors may improve the accuracy of information (e.g., directionality) describing a sound field produced by the transducer array 410 and/or sound from the local area.

The audio controller 430 controls operation of the audio system 400. In the embodiment of FIG. 4, the audio controller 430 includes a data store 435, a DOA estimation module 440, a transfer function module 450, a tracking module 460, a beamforming module 470, and a sound filter module 480. The audio controller 430 may be located inside a headset, in some embodiments. Some embodiments of the audio controller 430 have different components than those described here. Similarly, functions can be distributed among the components in different manners than described here. For example, some functions of the controller may be performed external to the headset. The user may opt in to allow the audio controller 430 to transmit data captured by the headset to systems external to the headset, and the user may select privacy settings controlling access to any such data.

The data store 435 stores data for use by the audio system 400. Data in the data store 435 may include sounds recorded in the local area of the audio system 400, audio content, head-related transfer functions (HRTFs), transfer functions for one or more sensors, array transfer functions (ATFs) for one or more of the acoustic sensors, sound source locations, virtual model of local area, direction of arrival estimates, sound filters, and other data relevant for use by the audio system 400, or any combination thereof.

The DOA estimation module 440 is configured to localize sound sources in the local area based in part on information from the sensor array 420. Localization is a process of determining where sound sources are located relative to the user of the audio system 400. The DOA estimation module 440 performs a DOA analysis to localize one or more sound sources within the local area. The DOA analysis may include analyzing the intensity, spectra, and/or arrival time of each sound at the sensor array 420 to determine the direction from which the sounds originated. In some cases, the DOA analysis may include any suitable algorithm for analyzing a surrounding acoustic environment in which the audio system 400 is located.

For example, the DOA analysis may be designed to receive input signals from the sensor array 420 and apply digital signal processing algorithms to the input signals to estimate a direction of arrival. These algorithms may include, for example, delay and sum algorithms where the input signal is sampled, and the resulting weighted and delayed versions of the sampled signal are averaged together to determine a DOA. A least mean squared (LMS) algorithm may also be implemented to create an adaptive filter. This adaptive filter may then be used to identify differences in signal intensity, for example, or differences in time of arrival. These differences may then be used to estimate the DOA. In another embodiment, the DOA may be determined by converting the input signals into the frequency domain and selecting specific bins within the time-frequency (TF) domain to process. Each selected TF bin may be processed to determine whether that bin includes a portion of the audio spectrum with a direct path audio signal. Those bins having a portion of the direct-path signal may then be analyzed to identify the angle at which the sensor array 420 received the direct-path audio signal. The determined angle may then be used to identify the DOA for the received input signal. Other algorithms not listed above may also be used alone or in combination with the above algorithms to determine DOA.

In some embodiments, the DOA estimation module 440 may also determine the DOA with respect to an absolute position of the audio system 400 within the local area. The position of the sensor array 420 may be received from an external system (e.g., some other component of a headset, an artificial reality console, a mapping server, a position sensor (e.g., the position sensor 150), etc.). The external system may create a virtual model of the local area, in which the local area and the position of the audio system 400 are mapped. The received position information may include a location and/or an orientation of some or all of the audio system 400 (e.g., of the sensor array 420). The DOA estimation module 440 may update the estimated DOA based on the received position information.

The transfer function module 450 is configured to generate one or more acoustic transfer functions. Generally, a transfer function is a mathematical function giving a corresponding output value for each possible input value. Based on parameters of the detected sounds, the transfer function module 450 generates one or more acoustic transfer functions associated with the audio system. The acoustic transfer functions may be array transfer functions (ATFs), head-related transfer functions (HRTFs), other types of acoustic transfer functions, or some combination thereof. An ATF characterizes how the microphone receives a sound from a point in space.

An ATF includes a number of transfer functions that characterize a relationship between the sound source and the corresponding sound received by the acoustic sensors in the sensor array 420. Accordingly, for a sound source there is a corresponding transfer function for each of the acoustic sensors in the sensor array 420. And collectively the set of transfer functions is referred to as an ATF. Accordingly, for each sound source there is a corresponding ATF. Note that the sound source may be, e.g., someone or something generating sound in the local area, the user, or one or more transducers of the transducer array 410. The ATF for a particular sound source location relative to the sensor array 420 may differ from user to user due to a person's anatomy (e.g., ear shape, shoulders, etc.) that affects the sound as it travels to the person's ears. Accordingly, the ATFs of the sensor array 420 are personalized for each user of the audio system 400.

In some embodiments, the transfer function module 450 determines one or more HRTFs for a user of the audio system 400. The HRTF characterizes how an ear receives a sound from a point in space. The HRTF for a particular source location relative to a person is unique to each ear of the person (and is unique to the person) due to the person's anatomy (e.g., ear shape, shoulders, etc.) that affects the sound as it travels to the person's ears. In some embodiments, the transfer function module 450 may determine HRTFs for the user using a calibration process. In some embodiments, the transfer function module 450 may provide information about the user to a remote system. The user may adjust privacy settings to allow or prevent the transfer function module 450 from providing the information about the user to any remote systems. The remote system determines a set of HRTFs that are customized to the user using, e.g., machine learning, and provides the customized set of HRTFs to the audio system 400.

The tracking module 460 is configured to track locations of one or more sound sources. The tracking module 460 may compare current DOA estimates and compare them with a stored history of previous DOA estimates. In some embodiments, the audio system 400 may recalculate DOA estimates on a periodic schedule, such as once per second, or once per millisecond. The tracking module may compare the current DOA estimates with previous DOA estimates, and in response to a change in a DOA estimate for a sound source, the tracking module 460 may determine that the sound source moved. In some embodiments, the tracking module 460 may detect a change in location based on visual information received from the headset or some other external source. The tracking module 460 may track the movement of one or more sound sources over time. The tracking module 460 may store values for a number of sound sources and a location of each sound source at each point in time. In response to a change in a value of the number or locations of the sound sources, the tracking module 460 may determine that a sound source moved. The tracking module 460 may calculate an estimate of the localization variance. The localization variance may be used as a confidence level for each determination of a change in movement.

The beamforming module 470 is configured to process one or more ATFs to selectively emphasize sounds from sound sources within a certain area while de-emphasizing sounds from other areas. In analyzing sounds detected by the sensor array 420, the beamforming module 470 may combine information from different acoustic sensors to emphasize sound associated from a particular region of the local area while deemphasizing sound that is from outside of the region. The beamforming module 470 may isolate an audio signal associated with sound from a particular sound source from other sound sources in the local area based on, e.g., different DOA estimates from the DOA estimation module 440 and the tracking module 460. The beamforming module 470 may thus selectively analyze discrete sound sources in the local area. In some embodiments, the beamforming module 470 may enhance a signal from a sound source. For example, the beamforming module 470 may apply sound filters which eliminate signals above, below, or between certain frequencies. Signal enhancement acts to enhance sounds associated with a given identified sound source relative to other sounds detected by the sensor array 420.

The sound filter module 480 determines sound filters for the transducer array 410. In some embodiments, the sound filters cause the audio content to be spatialized, such that the audio content appears to originate from a target region. The sound filter module 480 may use HRTFs and/or acoustic parameters to generate the sound filters. The acoustic parameters describe acoustic properties of the local area. The acoustic parameters may include, e.g., a reverberation time, a reverberation level, a room impulse response, etc. In some embodiments, the sound filter module 480 calculates one or more of the acoustic parameters. In some embodiments, the sound filter module 480 requests the acoustic parameters from a mapping server (e.g., as described below with regard to FIG. 5).

The sound filter module 480 provides the sound filters to the transducer array 410. In some embodiments, the sound filters may cause positive or negative amplification of sounds as a function of frequency.

Figure 5:
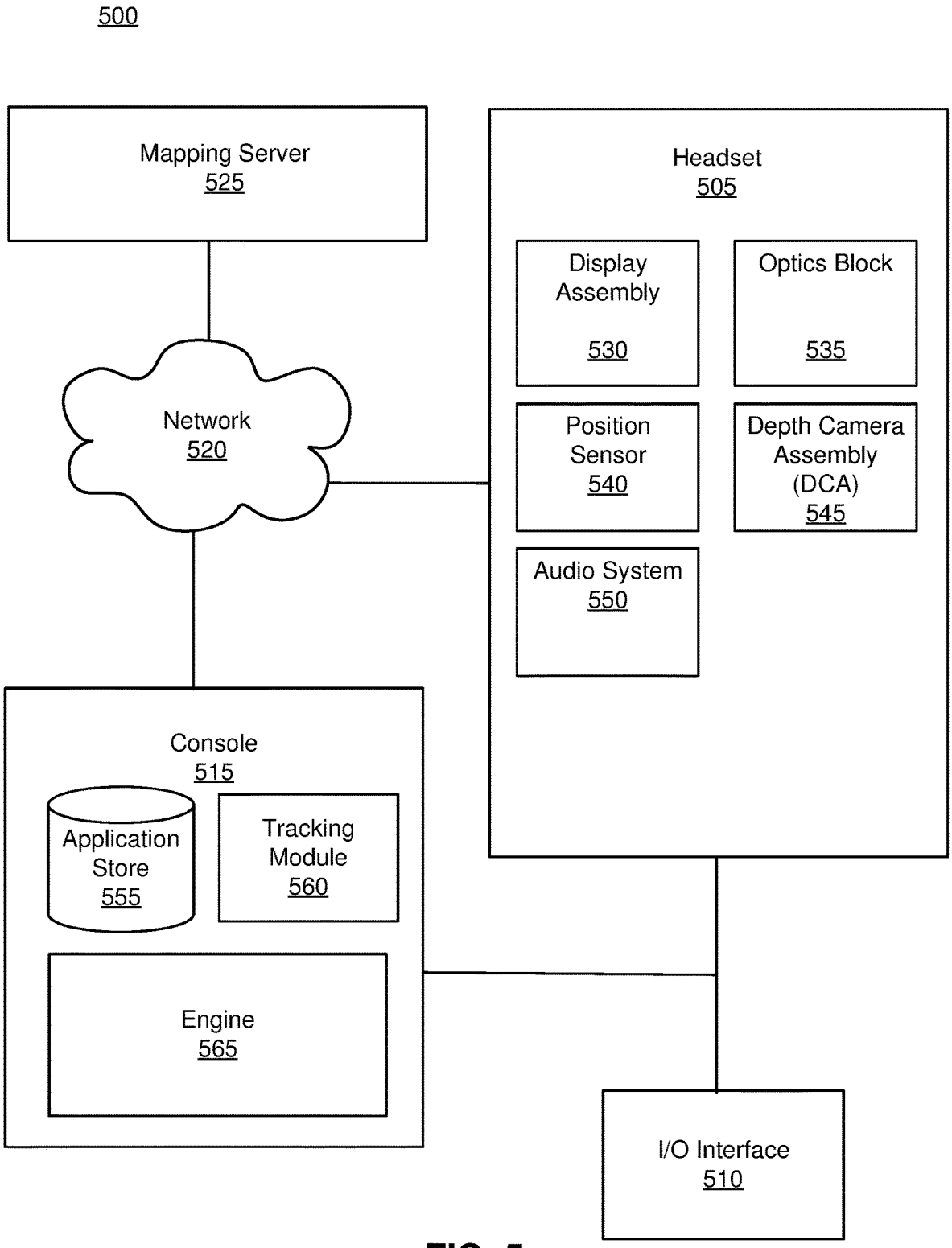
FIG. 5 is a block diagram of an example artificial reality system environment, in accordance with one or more embodiments.

FIG. 5 is a block diagram of an example artificial reality system environment 500, in accordance with one or more embodiments. In some embodiments, the system environment 500 includes a headset 505, in accordance with one or more embodiments. In some embodiments, the headset 505 may be the headset 100 of FIG. 1A or the headset 105 of FIG. 1B. The system 500 may operate in an artificial reality environment (e.g., a virtual reality environment, an augmented reality environment, a mixed reality environment, or some combination thereof). The system 500 shown by FIG. 5 includes the headset 505, an input/output (I/O) interface 510 that is coupled to a console 515, the network 520, and the mapping server 525. While FIG. 5 shows an example system 500 including one headset 505 and one I/O interface 510, in other embodiments any number of these components may be included in the system 500. For example, there may be multiple headsets each having an associated I/O interface 510, with each headset and I/O interface 510 communicating with the console 515. In alternative configurations, different and/or additional components may be included in the system 500. Additionally, functionality described in conjunction with one or more of the components shown in FIG. 5 may be distributed among the components in a different manner than described in conjunction with FIG. 5 in some embodiments. For example, some or all of the functionality of the console 515 may be provided by the headset 505.

The headset 505 includes the display assembly 530, an optics block 535, one or more position sensors 540, and the DCA 545. Some embodiments of headset 505 have different components than those described in conjunction with FIG. 5. Additionally, the functionality provided by various components described in conjunction with FIG. 5 may be differently distributed among the components of the headset 505 in other embodiments, or be captured in separate assemblies remote from the headset 505.

The display assembly 530 displays content to the user in accordance with data received from the console 515. The display assembly 530 displays the content using one or more display elements (e.g., the display elements 120). A display element may be, e.g., an electronic display. In various embodiments, the display assembly 530 comprises a single display element or multiple display elements (e.g., a display for each eye of a user). Examples of an electronic display include: a liquid crystal display (LCD), an organic light emitting diode (OLED) display, an active-matrix organic light-emitting diode display (AMOLED), a waveguide display, some other display, or some combination thereof. Note in some embodiments, the display element 120 may also include some or all of the functionality of the optics block 535.

The optics block 535 may magnify image light received from the electronic display, corrects optical errors associated with the image light, and presents the corrected image light to one or both eyeboxes of the headset 505. In various embodiments, the optics block 535 includes one or more optical elements. Example optical elements included in the optics block 535 include: an aperture, a Fresnel lens, a convex lens, a concave lens, a filter, a reflecting surface, or any other suitable optical element that affects image light. Moreover, the optics block 535 may include combinations of different optical elements. In some embodiments, one or more of the optical elements in the optics block 535 may have one or more coatings, such as partially reflective or anti-reflective coatings.

Magnification and focusing of the image light by the optics block 535 allows the electronic display to be physically smaller, weigh less, and consume less power than larger displays. Additionally, magnification may increase the field of view of the content presented by the electronic display. For example, the field of view of the displayed content is such that the displayed content is presented using almost all (e.g., approximately 110 degrees diagonal), and in some cases, all of the user's field of view. Additionally, in some embodiments, the amount of magnification may be adjusted by adding or removing optical elements.

In some embodiments, the optics block 535 may be designed to correct one or more types of optical error. Examples of optical error include barrel or pincushion distortion, longitudinal chromatic aberrations, or transverse chromatic aberrations. Other types of optical errors may further include spherical aberrations, chromatic aberrations, or errors due to the lens field curvature, astigmatisms, or any other type of optical error. In some embodiments, content provided to the electronic display for display is pre-distorted, and the optics block 535 corrects the distortion when it receives image light from the electronic display generated based on the content.

The position sensor 540 is an electronic device that generates data indicating a position of the headset 505. The position sensor 540 generates one or more measurement signals in response to motion of the headset 505. The position sensor 150 is an embodiment of the position sensor 540. Examples of a position sensor 540 include: one or more IMUS, one or more accelerometers, one or more gyroscopes, one or more magnetometers, another suitable type of sensor that detects motion, or some combination thereof. The position sensor 540 may include multiple accelerometers to measure translational motion (forward/back, up/down, left/right) and multiple gyroscopes to measure rotational motion (e.g., pitch, yaw, roll). In some embodiments, an IMU rapidly samples the measurement signals and calculates the estimated position of the headset 505 from the sampled data. For example, the IMU integrates the measurement signals received from the accelerometers over time to estimate a velocity vector and integrates the velocity vector over time to determine an estimated position of a reference point on the headset 505. The reference point is a point that may be used to describe the position of the headset 505. While the reference point may generally be defined as a point in space, however, in practice the reference point is defined as a point within the headset 505.

The DCA 545 generates depth information for a portion of the local area. The DCA includes one or more imaging devices and a DCA controller. The DCA 545 may also include an illuminator. Operation and structure of the DCA 545 is described above with regard to FIG. 1A.

The audio system 550 provides audio content to a user of the headset 505. The audio system 550 is substantially the same as the audio system 200 describe above. The audio system 550 may comprise one or acoustic sensors, one or more transducers, and an audio controller. The audio system 550 may provide spatialized audio content to the user. In some embodiments, the audio system 550 may request acoustic parameters from the mapping server 525 over the network 520. The acoustic parameters describe one or more acoustic properties (e.g., room impulse response, a reverberation time, a reverberation level, etc.) of the local area. The audio system 550 may provide information describing at least a portion of the local area from e.g., the DCA 545 and/or location information for the headset 505 from the position sensor 540. The audio system 550 may generate one or more sound filters using one or more of the acoustic parameters received from the mapping server 525, and use the sound filters to provide audio content to the user.

The audio system 550 may be an embodiment of the audio system 400 of FIG. 4. The audio system 550 may include a transducer array (e.g., the transducer array 410) that includes one or more speaker assemblies (e.g., the speaker assembly 180*a* and/or 180B) that limit the leakage of audio content presented to the user, while enhancing playback for the user. The one or more speaker assemblies each respectively include a positive vent assembly and a negative vent assembly. The positive vent assembly provides positive acoustic pressure waves produced by a speaker of the speaker assembly to an entrance of an ear canal of the user. The negative vent assembly, positioned behind a pinna of the user, outputs negative acoustic pressure waves to an area behind the pinna. The pinna provides an acoustic shadowing effect between the positive and negative vent assemblies, mitigating destructive interference that would otherwise occur if the path between the positive and negative vent assemblies was not obstructed by the pinna. Accordingly, the audio system 550 enhances audio presented to the user, while mitigating leakage.

The I/O interface 510 is a device that allows a user to send action requests and receive responses from the console 515. An action request is a request to perform a particular action. For example, an action request may be an instruction to start or end capture of image or video data, or an instruction to perform a particular action within an application. The I/O interface 510 may include one or more input devices. Example input devices include: a keyboard, a mouse, a game controller, or any other suitable device for receiving action requests and communicating the action requests to the console 515. An action request received by the I/O interface 510 is communicated to the console 515, which performs an action corresponding to the action request. In some embodiments, the I/O interface 510 includes an IMU that captures calibration data indicating an estimated position of the I/O interface 510 relative to an initial position of the I/O interface 510. In some embodiments, the I/O interface 510 may provide haptic feedback to the user in accordance with instructions received from the console 515. For example, haptic feedback is provided when an action request is received, or the console 515 communicates instructions to the I/O interface 510 causing the I/O interface 510 to generate haptic feedback when the console 515 performs an action.

The console 515 provides content to the headset 505 for processing in accordance with information received from one or more of: the DCA 545, the headset 505, and the I/O interface 510. In the example shown in FIG. 5, the console 515 includes an application store 555, a tracking module 560, and an engine 565. Some embodiments of the console 515 have different modules or components than those described in conjunction with FIG. 5. Similarly, the functions further described below may be distributed among components of the console 515 in a different manner than described in conjunction with FIG. 5. In some embodiments, the functionality discussed herein with respect to the console 515 may be implemented in the headset 505, or a remote system.

The application store 555 stores one or more applications for execution by the console 515. An application is a group of instructions, that when executed by a processor, generates content for presentation to the user. Content generated by an application may be in response to inputs received from the user via movement of the headset 505 or the I/O interface 510. Examples of applications include: gaming applications, conferencing applications, video playback applications, or other suitable applications.

The tracking module 560 tracks movements of the headset 505 or of the I/O interface 510 using information from the DCA 545, the one or more position sensors 540, or some combination thereof. For example, the tracking module 560 determines a position of a reference point of the headset 505 in a mapping of a local area based on information from the headset 505. The tracking module 560 may also determine positions of an object or virtual object. Additionally, in some embodiments, the tracking module 560 may use portions of data indicating a position of the headset 505 from the position sensor 540 as well as representations of the local area from the DCA 545 to predict a future location of the headset 505. The tracking module 560 provides the estimated or predicted future position of the headset 505 or the I/O interface 510 to the engine 565.

The engine 565 executes applications and receives position information, acceleration information, velocity information, predicted future positions, or some combination thereof, of the headset 505 from the tracking module 560. Based on the received information, the engine 565 determines content to provide to the headset 505 for presentation to the user. For example, if the received information indicates that the user has looked to the left, the engine 565 generates content for the headset 505 that mirrors the user's movement in a virtual local area or in a local area augmenting the local area with additional content. Additionally, the engine 565 performs an action within an application executing on the console 515 in response to an action request received from the I/O interface 510 and provides feedback to the user that the action was performed. The provided feedback may be visual or audible feedback via the headset 505 or haptic feedback via the I/O interface 510.

The network 520 couples the headset 505 and/or the console 515 to the mapping server 525. The network 520 may include any combination of local area and/or wide area networks using both wireless and/or wired communication systems. For example, the network 520 may include the Internet, as well as mobile telephone networks. In one embodiment, the network 520 uses standard communications technologies and/or protocols. Hence, the network 520 may include links using technologies such as Ethernet, 802.11, worldwide interoperability for microwave access (WiMAX), 2G/3G/4G mobile communications protocols, digital subscriber line (DSL), asynchronous transfer mode (ATM), InfiniBand, PCI Express Advanced Switching, etc. Similarly, the networking protocols used on the network 520 can include multiprotocol label switching (MPLS), the transmission control protocol/Internet protocol (TCP/IP), the User Datagram Protocol (UDP), the hypertext transport protocol (HTTP), the simple mail transfer protocol (SMTP), the file transfer protocol (FTP), etc. The data exchanged over the network 520 can be represented using technologies and/or formats including image data in binary form (e.g. Portable Network Graphics (PNG)), hypertext markup language (HTML), extensible markup language (XML), etc. In addition, all or some of links can be encrypted using conventional encryption technologies such as secure sockets layer (SSL), transport layer security (TLS), virtual private networks (VPNs), Internet Protocol security (IPsec), etc.

The mapping server 525 may include a database that stores a virtual model describing a plurality of spaces, wherein one location in the virtual model corresponds to a current configuration of a local area of the headset 505. The mapping server 525 receives, from the headset 505 via the network 520, information describing at least a portion of the local area and/or location information for the local area. The user may adjust privacy settings to allow or prevent the headset 505 from transmitting information to the mapping server 525. The mapping server 525 determines, based on the received information and/or location information, a location in the virtual model that is associated with the local area of the headset 505. The mapping server 525 determines (e.g., retrieves) one or more acoustic parameters associated with the local area, based in part on the determined location in the virtual model and any acoustic parameters associated with the determined location. The mapping server 525 may transmit the location of the local area and any values of acoustic parameters associated with the local area to the headset 505.

One or more components of system 500 may contain a privacy module that stores one or more privacy settings for user data elements. The user data elements describe the user or the headset 505. For example, the user data elements may describe a physical characteristic of the user, an action performed by the user, a location of the user of the headset 505, a location of the headset 505, an HRTF for the user, etc. Privacy settings (or "access settings") for a user data element may be stored in any suitable manner, such as, for example, in association with the user data element, in an index on an authorization server, in another suitable manner, or any suitable combination thereof.

A privacy setting for a user data element specifies how the user data element (or particular information associated with the user data element) can be accessed, stored, or otherwise used (e.g., viewed, shared, modified, copied, executed, surfaced, or identified). In some embodiments, the privacy settings for a user data element may specify a "blocked list" of entities that may not access certain information associated with the user data element. The privacy settings associated with the user data element may specify any suitable granularity of permitted access or denial of access. For example, some entities may have permission to see that a specific user data element exists, some entities may have permission to view the content of the specific user data element, and some entities may have permission to modify the specific user data element. The privacy settings may allow the user to allow other entities to access or store user data elements for a finite period of time.

The privacy settings may allow a user to specify one or more geographic locations from which user data elements can be accessed. Access or denial of access to the user data elements may depend on the geographic location of an entity who is attempting to access the user data elements. For example, the user may allow access to a user data element and specify that the user data element is accessible to an entity only while the user is in a particular location. If the user leaves the particular location, the user data element may no longer be accessible to the entity. As another example, the user may specify that a user data element is accessible only to entities within a threshold distance from the user, such as another user of a headset within the same local area as the user. If the user subsequently changes location, the entity with access to the user data element may lose access, while a new group of entities may gain access as they come within the threshold distance of the user.

The system 500 may include one or more authorization/privacy servers for enforcing privacy settings. A request from an entity for a particular user data element may identify the entity associated with the request and the user data element may be sent only to the entity if the authorization server determines that the entity is authorized to access the user data element based on the privacy settings associated with the user data element. If the requesting entity is not authorized to access the user data element, the authorization server may prevent the requested user data element from being retrieved or may prevent the requested user data element from being sent to the entity. Although this disclosure describes enforcing privacy settings in a particular manner, this disclosure contemplates enforcing privacy settings in any suitable manner.

Additional Configuration Information

The foregoing description of the embodiments has been presented for illustration; it is not intended to be exhaustive or to limit the patent rights to the precise forms disclosed. Persons skilled in the relevant art can appreciate that many modifications and variations are possible considering the above disclosure.

Some portions of this description describe the embodiments in terms of algorithms and symbolic representations of operations on information. These algorithmic descriptions and representations are commonly used by those skilled in the data processing arts to convey the substance of their work effectively to others skilled in the art. These operations, while described functionally, computationally, or logically, are understood to be implemented by computer programs or equivalent electrical circuits, microcode, or the like. Furthermore, it has also proven convenient at times, to refer to these arrangements of operations as modules, without loss of generality. The described operations and their associated modules may be embodied in software, firmware, hardware, or any combinations thereof.

Any of the steps, operations, or processes described herein may be performed or implemented with one or more hardware or software modules, alone or in combination with other devices. In one embodiment, a software module is implemented with a computer program product comprising a computer-readable medium containing computer program code, which can be executed by a computer processor for performing any or all the steps, operations, or processes described.

Embodiments may also relate to an apparatus for performing the operations herein. This apparatus may be specially constructed for the required purposes, and/or it may comprise a general-purpose computing device selectively activated or reconfigured by a computer program stored in the computer. Such a computer program may be stored in a non-transitory, tangible computer readable storage medium, or any type of media suitable for storing electronic instructions, which may be coupled to a computer system bus. Furthermore, any computing systems referred to in the specification may include a single processor or may be architectures employing multiple processor designs for increased computing capability.

Embodiments may also relate to a product that is produced by a computing process described herein. Such a product may comprise information resulting from a computing process, where the information is stored on a non-transitory, tangible computer readable storage medium and may include any embodiment of a computer program product or other data combination described herein.

Finally, the language used in the specification has been principally selected for readability and instructional purposes, and it may not have been selected to delineate or circumscribe the patent rights. It is therefore intended that the scope of the patent rights be limited not by this detailed description, but rather by any claims that issue on an application based hereon. Accordingly, the disclosure of the embodiments is intended to be illustrative, but not limiting, of the scope of the patent rights, which is set forth in the following claims.

What is claimed is:

1. A body element comprising:

a first vent assembly configured to vent positive acoustic pressure waves from within the body element to an entrance of an ear canal of an ear of a user, the positive acoustic pressure waves emitted by a speaker;

a second vent assembly configured to vent negative pressure waves from within the body element to an area behind a pinna of the ear, wherein the negative acoustic pressure waves are emitted by the speaker; and a waveguide that provides an acoustic pathway for the negative acoustic pressure waves from the speaker to the second vent assembly.

2. The body element of claim 1, wherein the first vent assembly is parallel to the second vent assembly.

3. The body element of claim 1, wherein the waveguide within the body element is formed from the body element.

4. The body element of claim 1, further comprising:

a second waveguide within the body element configured to provide an acoustic pathway for the positive acoustic pressure waves from the speaker to the first vent assembly.

5. The body element of claim 1, wherein the second vent assembly is configured to reduce interference in a near acoustic field and provide cancellation in a far acoustic field.

6. The body element of claim 1, wherein the body element is part of an audio system that is a part of a headset.

7. The body element of claim 6, wherein the second vent assembly is located in a frame of the headset.

8. The body element of claim 6, wherein a first portion of the second vent assembly is located in the frame of the headset and a second portion of the second vent assembly is located external to the frame of the headset.

9. The body element of claim 1, wherein the speaker is positioned proximate to the entrance to the ear canal of the user.

10. An audio system comprising:

a first body element, the first body element comprising:

a first vent assembly configured to vent positive acoustic pressure waves from within the first body element to an entrance of an ear canal of a first ear of a user, the positive acoustic pressure waves emitted by a first speaker, a second vent assembly configured to vent negative pressure waves from within the first body element to an area behind a pinna of the first ear, wherein the negative acoustic pressure waves are emitted by the first speaker, a first waveguide that provides an acoustic pathway for the negative acoustic pressure waves from the first speaker to the second vent assembly; and a second body element, the second body element comprising:

a third vent assembly configured to vent positive acoustic pressure waves from within the second body element to an entrance of an ear canal of a second ear of the user, the positive acoustic pressure waves emitted by a second speaker, a fourth vent assembly configured to vent negative pressure waves from within the second body element to an area behind a pinna of the second ear, wherein the negative acoustic pressure waves are emitted by the second speaker, and a second waveguide that provides an acoustic pathway for the negative acoustic pressure waves from the second speaker to the fourth vent assembly.

11. The audio system of claim 10, wherein the first waveguide within the first body element is formed from the first body element.

12. The audio system of claim 10, wherein the second waveguide within the second body element is formed from the second body element.

13. The audio system of claim 10, further comprising:

a third waveguide within the first body element configured to provide an acoustic pathway for the positive acoustic pressure waves from the first speaker to the first vent assembly.

14. The audio system of claim 10, wherein the second vent assembly is configured to reduce interference in a near acoustic field and provide cancellation in a far acoustic field.

15. The audio system of claim 10, wherein the fourth vent assembly is configured to reduce interference in a near acoustic field and provide cancellation in a far acoustic field.

16. The audio system of claim 10, wherein the audio system that is a part of a headset.

17. The audio system of claim 16, wherein the second vent assembly is located in a frame of the headset.

18. The audio system of claim 16, wherein a first portion of the second vent assembly is located in the frame of the headset and a second portion of the second vent assembly is located external to the frame of the headset.

19. The audio system of claim 10, wherein the first speaker is positioned proximate to the entrance to the ear canal of the first ear.

20. The audio system of claim 10, wherein the second speaker is positioned proximate to the entrance to the ear canal of the second ear.

* * * * *